US007970326B2

(12) United States Patent
Ito et al.

(10) Patent No.: US 7,970,326 B2
(45) Date of Patent: Jun. 28, 2011

(54) IMAGE FORMING APPARATUS AND IMAGE PRINTING SYSTEM FOR BORDERLESS PRINTING

(75) Inventors: Katsuyuki Ito, Tokyo (JP); Taku Kimura, Tokya (JP)

(73) Assignee: Oki Data Corporation, Tokyo (JP)

( * ) Notice: Subject to any disclaimer, the term of this patent is extended or adjusted under 35 U.S.C. 154(b) by 575 days.

(21) Appl. No.: 11/466,949

(22) Filed: Aug. 24, 2006

(65) Prior Publication Data

US 2007/0059058 A1 Mar. 15, 2007

(30) Foreign Application Priority Data

Sep. 12, 2005 (JP) ..... 2005-263497

(51) Int. Cl.
*G03G 15/20* (2006.01)

(52) U.S. Cl. ..... 399/323; 399/325; 399/328; 399/329

(58) Field of Classification Search ..... 399/323, 399/325, 328, 329
See application file for complete search history.

(56) References Cited

U.S. PATENT DOCUMENTS 6,385,424 B1 * 5/2002 Lee et al. ..... 399/324
6,795,676 B2 * 9/2004 Kikuchi et al. ..... 399/323
2005/0036808 A1 * 2/2005 Abe ..... 399/325
2005/0157134 A1 * 7/2005 Noguchi et al. ..... 347/101
2005/0169650 A1 * 8/2005 Ito et al. ..... 399/45
2005/0244735 A1 * 11/2005 Ogata et al. ..... 399/159
2006/0024096 A1 * 2/2006 Kimura ..... 399/325

FOREIGN PATENT DOCUMENTS

JP 2001083832 A 3/2001
JP 2004151260 A 5/2004
JP 7-34450 U 8/2006

* cited by examiner

*Primary Examiner* — Ryan D Walsh
(74) *Attorney, Agent, or Firm* — Panitch Schwarze Belisario & Nadel LLP

(57) ABSTRACT

An image forming apparatus includes a determining unit, an image forming unit, a fixing member, a pressing member, a separating member and a release agent applying member. The determining unit determines whether to print a borderless image or not. The image forming unit forms a developer image on a recording medium in accordance with the printing data so that the developer image reaches the vicinity of a leading end of the recording medium. The fixing member fixes the developer image to the recording medium. The pressing member is pressed against the fixing member to form a nip portion therebetween. The separating member is disposed on a downstream side of the nip portion so that the separating member has no contact with the fixing member. The separating member separates the recording medium from the fixing member. The release agent applying member applies a release agent to the fixing member.

21 Claims, 11 Drawing Sheets

(EXPERIMENT 1)

FIG.4

RELATIONSHIP BETWEEN RUBBER HARDNESS AND PEELING TEST RESULT OF RECORDING MEDIUM WITH BORDERLESS IMAGE FORMED THEREON (EXPERIMENT 2)

| TEST No. | RUBBER HARDNESS OF FIXING ROLLER 25 (degrees) | RUBBER HARDNESS OF PRESSING ROLLER 26 (degrees) | RESULT OF PEELING TEST | PEELING FORCE |
|---|---|---|---|---|
| No.1 | 70 | 95 | SUCCESS | 350gf |
| No.2 | 70 | 85 | SUCCESS | 200gf |
| No.3 | 70 | 70 | SUCCESS | 100gf |
| No.4 | 70 | 50 | FAILURE | – |

IMAGE FORMING APPARATUS AND IMAGE PRINTING SYSTEM FOR BORDERLESS PRINTING

BACKGROUND OF THE INVENTION

This invention relates to an image forming apparatus, an image processing apparatus and an image printing system used in an electrophotographic printer, copier, facsimile machine or combined machine. In particular, this invention relates to an image forming apparatus and an image printing system capable of borderless printing.

In an image forming process, a toner having been transferred to a recording medium is fixed to the recording medium by means of a fixing device. In the fixing device, there may be cases in which the recording medium is not well separated from a fixing member (for example, a fixing roller). Therefore, a separating claw is provided in contact with the surface of the fixing member so that the recording medium can be peeled off and separated from the fixing member, as disclosed in Japanese Utility Model Laid-Open Publication No. 7-34450 (page 3, FIG. 1). Further, no toner image is formed on a leading end of the recording medium. Further, a non-printing area (i.e., a margin on which no toner image is formed) is provided on the leading end of the recording medium, so that the recording medium can be separated from the fixing member due to the firmness of the leading end of the recording medium.

Recently, there is a need for a function to print a borderless image without leaving the non-printing area on the leading end of the recording medium (i.e., a borderless printing). If the borderless printing is performed, since the non-printing area is not provided on the leading end of the recording medium, the firmness of the leading end of the recording medium decreases, and therefore the recording medium may not be peeled off and separated from the fixing member. In such a case, the recording medium may be wound around the fixing member. For that occasions, the above described separating claw (i.e., a separating means) is provided in contact with the fixing member, and the separating claw peels off and separates the leading end of the recording medium from the fixing member.

However, if the separating claw is provided in contact with the fixing member for peeling off and separating the recording medium from the fixing member, a scratch may be formed on the surface of the fixing member. In such a case, when the toner image is fixed to the recording medium, the scratch may cause a strip or a pattern to be formed on an image, and therefore the image quality may be degraded. Accordingly, the provision of the separating claw for separating the recording medium from the fixing member has a problem.

SUMMARY OF THE INVENTION

An object of the present invention is to provide an image forming apparatus and an image printing system capable of surely separating a recording medium from a fixing member after a fixing process without damaging the fixing member.

The present invention provides an image forming apparatus including a determining unit, an image forming unit, a fixing member, a pressing member, a separating member and a release agent applying member. The determining unit determines whether to print a borderless image or not, when the determining unit receives a printing data of the borderless image from a host device. The image forming unit forms a developer image on a recording medium in accordance with the printing data so that the developer image reaches the vicinity of a leading end of the recording medium in a feeding direction thereof, in the case where the determining unit determines to print the borderless image. The fixing member is heated by a heat source so as to fix the developer image to the recording medium. The pressing member is disposed in opposition to the fixing member, and is pressed against the fixing member to form a nip portion therebetween. The separating member is disposed on a downstream side of the nip portion so that the separating member has no contact with the fixing member, and separates the recording medium from the fixing member. The release agent applying member applies a release agent to the fixing member.

BRIEF DESCRIPTION OF THE DRAWINGS

In the attached drawings:

FIG. 4 shows a result of determination whether a leading end of a recording medium (whose basis weight is 64 g/m$^2$ and on which a toner image is transferred) is peeled off from the fixing roller when a rubber hardness (ASKER-C) of an experimental pressing roller is varied, and shows a maximum peeling force when the recording medium is peeled off from the fixing roller;

DETAILED DESCRIPTION OF THE PREFERRED EMBODIMENT

Embodiments of the present invention will be described with reference to the attached drawings.

Embodiment 1

Figure 1:
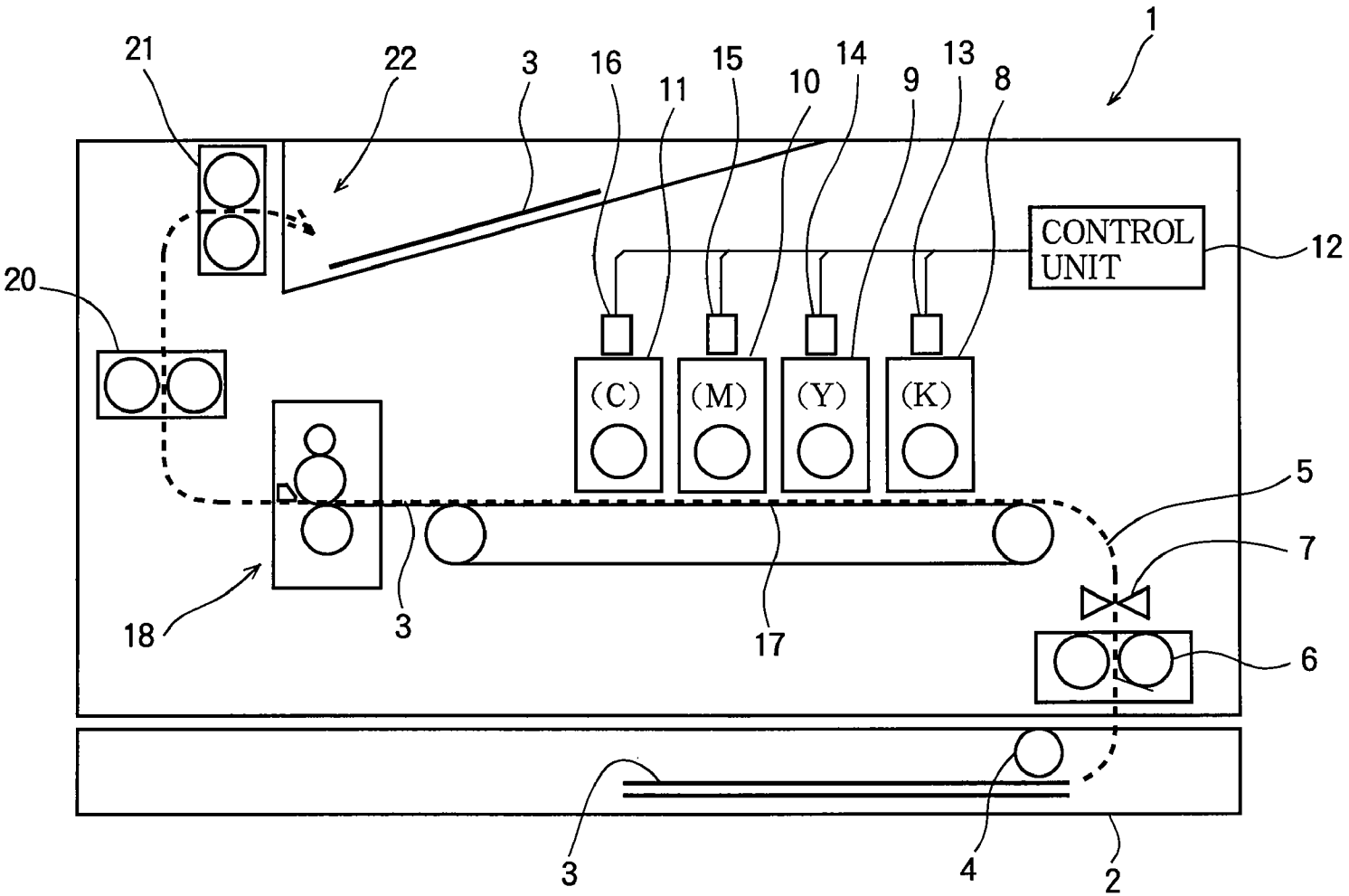
FIG. 1 shows a configuration of a main part of an image forming apparatus according to Embodiment 1 of the present invention.

FIG. 1 shows a configuration of a main part of an image forming apparatus according to Embodiment 1 of the present invention. In FIG. 1, the image forming apparatus 1 is configured as an electrophotographic color printer capable of printing four colors, i.e., black (K), yellow (Y), magenta (M) and cyan (C). A medium cassette 2 stores a plurality of recording media 3, and a feed roller 4 feeds the uppermost recording medium 3 to a feeding path 5 one by one at predetermined timings. A writing sensor 6 is provided on the feeding path 5. The writing sensor 6 detects a leading end of the recording medium 3 fed along the feeding path 5, and outputs a detection signal to a control unit 12 for determining the timing of writing an image as described later. A medium thickness sensor 7 detects the thickness of the recording medium 3 fed along the feeding path 5, and outputs a thickness information to the control unit 12.

In the image forming apparatus 1, four image forming units 8, 9, 10 and 11 are disposed along the feeding path 5 of the recording medium 3. The image forming units 8, 9, 10 and 11 are arranged in this order from the upstream side to the downstream side of the feeding path 5. The image forming units 8, 9, 10 and 11 respectively have toners (i.e., developers) of black (K), yellow (Y), magenta (M) and cyan (C).

The control unit 12 receives a borderless image processing data (as a printing data) sent from a host device such as a host computer 100 (FIG. 8), and creates a borderless image forming data (for example, bitmap data) as a printing image data in a format which is recognizable by a lower-level device. Optical writing devices 13, 14, 15 and 16 are disposed on positions corresponding to the image forming units 8, 9, 10 and 11. The optical writing devices 13, 14, 15 and 16 receive the borderless image forming data (created by the control unit 12) of the corresponding colors, and perform optical writing on the image forming units 8, 9, 10 and 11 at predetermined timings.

A transfer belt 17 holds the recording medium 3 fed from the upstream side of the feeding path 5. The transfer belt 17 causes the toners of the respective colors of the image forming units 8, 9, 10 and 11 to be transferred to the recording medium 3. The transfer belt 17 carries the recording medium 3 with an unfixed toner image to a fixing device 18. The unfixed toner is heated and melted by the fixing device 18, and is fixed to the recording medium 3. After the recording medium 3 with the fixed toner image is ejected from the fixing device 18, the recording medium 3 is carried by carrying rollers 20 and 21 and ejected to a medium stacker 22 on the exterior of the image forming apparatus 1.

Figure 2A:
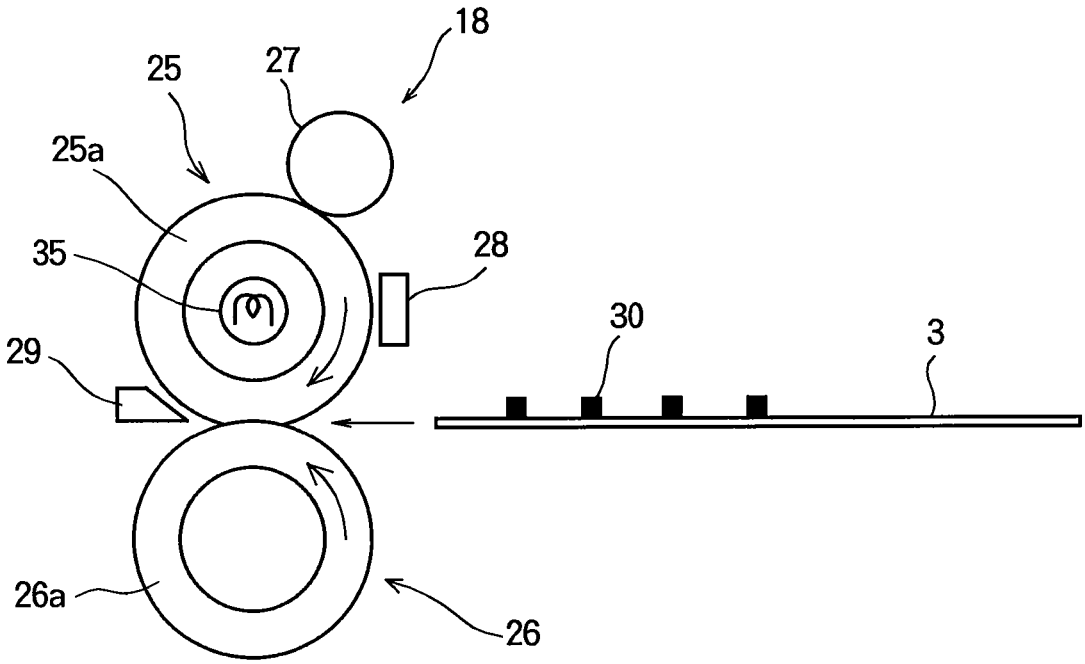
FIG. 2A shows an internal structure of a fixing device according to Embodiment 1.
Figure 2B:
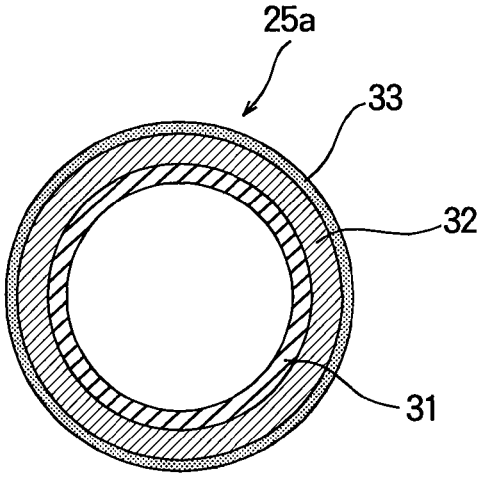
FIG. 2B is a sectional view showing a structure of a roller portion of a fixing roller according to Embodiment 1.

FIG. 2A shows an internal structure of the fixing device 18. As shown in FIG. 2A, the fixing device 18 includes a fixing roller 25, a pressing roller 26, a release agent applying member 27, a temperature detector 28 and a medium separating member 29. The fixing roller 25 includes a roller portion 25*a* and a heat source 35 provided in the roller portion 25*a*. FIG. 2B is a sectional view showing a structure of the fixing roller 25. As shown in FIG. 2B, the roller portion 25*a* includes a hollow metal core 31 in which the heat source 35 is provided, a resilient layer 32 formed on the outer surface of the hollow metal core 31, and a releasing layer 33 formed on the surface of the resilient layer 32.

The hollow metal core 31 is made of a pipe composed of metal such as aluminum, iron, stainless steal or the like, in order to obtain a certain rigidity. The resilient layer 32 is made of a rubber having high heat resistance such as silicone rubber (preferably having the thickness approximately from 0.5 mm to 2 mm), sponge-like silicone rubber, fluoro rubber or the like.

The releasing layer 33 is made of a resin having high heat resistance and small surface free energy (after molding), for example, representative fluoro resin preferably having the thickness approximately from 10 μm to 50 μm, such as PTFE (Poly-Tetra-Fluoro-Ethylene), PFA (Per-Fluoroalkoxyl-Alkane), FEP (Fluorinated-Ethylene-Propylene-copolymer) or the like. Further, the surface of the releasing layer 33 has a certain roughness with concaves and convexes for holding the release agent applied by the release agent applying member 27 as described later.

The pressing roller 26 includes a roller portion 26*a*. The roller portion 26*a* includes a hollow metal core and a resilient layer formed on the outer surface of the hollow metal core, as is the case with the fixing roller 25. The hollow metal core of the pressing roller 26 is made of a pipe composed of metal such as aluminum, iron, stainless steal or the like, in order to obtain a certain rigidity. The resilient layer of the pressing roller 26 is composed of rubber having high heat resistance such as silicone rubber, sponge-like silicone rubber, fluoro rubber or the like. In the case where a duplex printing is available in the image forming apparatus, the pressing roller 26 further has the releasing layer on the surface thereof, as is the case with the fixing roller 25.

The fixing roller 25 and the pressing roller 26 are pressed against each other with a predetermined force so that a fixing nip portion is formed therebetween. The temperature detector 28 detects the surface temperature of the fixing roller 25. The medium separating member 29 has no contact with the fixing roller 25. The tip of the medium separating member 29 is in the vicinity of the downstream end of the fixing nip portion and is closer to the fixing roller 25 than to the pressing roller 26. The gap between the medium separating member 29 and the fixing roller 25 is 0.3 mm to 1.0 mm.

The release agent applying member 27 is provided in contact with the surface of the fixing roller 25. As the release agent, it is possible to use a material which is excellent in heat resistance, releasing property and chemical stability, such as dimethyl-silicone oil, modified dimethyl-silicone oil or fluorine oil. As the release agent applying member 27, it is possible to use an application roller impregnated with the release agent and in contact with the fixing roller 25. Instead of the application roller, it is possible to use a felt impregnated with the release agent and in contact with the fixing roller 25. Further, it is also possible to use a spray for spraying the release agent (made into mist) to the fixing roller 25. It is also possible to use a porous film through which the release agent bleeds so that the release agent is applied to the fixing roller 25. It is also possible to use other various kinds of arrangement for applying the release agent to the fixing roller 25. In the case where the application roller is used, it is possible to use the silicone oil of 60 g. For example, by applying the silicone oil of 6 mg for each recording medium 3 of A4 size, the silicone oil (60 g) can be used for 10,000 recording media 3. In such a case, an oil roller (impregnated with the silicone oil) can supply a total amount of the silicone oil for 10,000 recording media 3, and therefore the configuration of the fixing device 18 can be minimized.

The unfixed toner 30 is transferred to the recording medium 3. As a binder resin used in the toner 30, it is possible to use polystyrene, styrene/propyrene copolymer, styrene/ methyl acrylate copolymer, styrene/buthyl acrylate copolymer, polyester copolymer, aliphatic or alicyclic hydrocarbon resin, aromatic petroleum resin or the like. The above described materials can be used individually, or two or more of the materials can be used in combination with each other.

In this embodiment, in order to obtain preferable binding properties, electrical characteristics or the like, it is preferable that the toner 30 contains at least a kind of resin selected among styrene/acrylic copolymer resin and polyester resin. Further, there is a case where the toner 30 contains a wax for preventing an offset, i.e., a phenomena that the toner 30 sticks to the fixing roller 25 during the fixing process. In such a case, it is possible to use polyethylene wax, propylene wax, carnauba wax or various ester wax. The melting point of the wax is preferably from 50 to 140° C. The melting point of the wax is more preferably from 60 to 130° C., and further more preferably from 70 to 120° C. If the melting point of the wax is lower than 50° C., the desorption or the seepage of the wax from the surface of the toner 30 may occur. If the melting point of the wax is higher than 140° C., it is difficult to sufficiently prevent the offset. Further, as the coloring agent of the toner 30, it is possible to use pigment or dye generally used as a coloring agent of the toner.

In this embodiment, in order to find conditions that enable a borderless printing (i.e., a printing without leaving a margin at the leading end of the recording medium 3), a peel resistance is experimentally determined. The peel resistance is an adhesive force with which the recording medium 3 adheres to the fixing roller 25 (FIG. 2). The result of the experiment 1 will be described below.

In order to find the above described conditions, the relationship between the peel resistance and the content of the wax (i.e., the wax content) in the toner 30 is experimentally determined. Further, the relationship between the peel resistance and the amount of the release agent applied to the fixing roller 25 by the release agent applying member 27 is experimentally determined. The peel resistance is measured by means of, for example, the fixing device 18. In this regard, the medium separating member 29 is not provided in the fixing device 18, and the fixing roller 25 is replaced by an experimental fixing roller 25' having no resilient layer, so that the recording medium 3 passing through the fixing device 18 is intentionally wound around the experimental fixing roller 25'.

On the measurement of the peel resistance, the operation of the fixing device 18 is stopped when the leading end of the recording medium 3 reaches a position where the experimental fixing roller 25' rotates by 90 degrees from the downstream end of the fixing nip portion. In this stopped state, a plate-like holder having the width of 297 mm and the thickness of 5 mm is attached to the leading end of the recording medium 3 using a double-sided adhesive tape having the width of 297 mm and the thickness of 5 mm. Then, the center of the holder is pulled in a direction perpendicular to the surface of the experimental fixing roller 25' using a tension gauge in such a manner that the tension increases at the rate of 100 gf/s. When the recording medium 3 is peeled off from the surface of the experimental fixing roller 25', the tension gauge is read.

The measurement result may be influenced by a fixing temperature, a feeding speed of the recording medium 3, and the pulling speed of the tension gauge. However, when the experiment is repeated 10 times under the same conditions, the variation of the experimental results is within ±8% with respect to the average. Thus, it is understood that the experimental result has a sufficient repeatability. Each data of the peel resistance (that will be described with reference to the following graphs) represents an average over 10 times.

The measurement conditions of the experiment 1 will be described below.

The conditions of the experimental fixing roller 25' are as follows:

diameter: 36 mm,
material: aluminum pipe,
pipe wall thickness: 1.5 mm,
releasing layer: PFA tube whose thickness is 30 μm,
surface roughness: 0.2 μm (Rz),
resilient layer: not provided, and
hardness: 95 degrees (ASKER C).

The conditions of the pressing roller 26 are as follows:

diameter: 36 mm,
material: aluminum pipe,
pipe wall thickness: 1.5 mm,
releasing layer: PFA tube whose thickness is 30 μm,
surface roughness: 0.2 μm (Rz),
resilient layer: silicone rubber whose thickness is 2.0 mm, and
hardness: 70 degrees (ASKER C).

The pressing force is 30 kgf.

The type of the toner is emulsion polymerization toner (Yellow, Magenta and Cyan), and wax content of the toner is varied in the range from 0 to 40 weight parts.

The basis weight and size of the recording medium are respectively 64 g/m$^2$ and A4 size, and the feeding direction of the recording medium is the width direction (i.e., the traverse feed).

The transferring amount of the toner is 1.5±0.1 g per sheet.

The feeding speed of the recording medium is 100 mm/s.

The temperatures of the experimental fixing roller 25' and the pressing roller 26 are respectively 160° C. and 130° C.

The release agent is composed of dimethyl silicone whose viscosity is 300 cSt, and the applying amount of the release agent is varied in the range from 0 to 8 mg per sheet.

The release agent is applied to the experimental fixing roller 25' using a roller having a porous surface layer impregnated with the above described release agent contacting the experimental fixing roller 25'.

The recording medium having the basis weight of 64 g/m$^2$ is in the category of a relatively thin copy sheet. The reason why such a recording medium is used in the experiment is to tighten conditions. The transferring amount of the toner is so adjusted that the density is at its maximum when the images of yellow, magenta and cyan are superimposed on the recording medium. The toner is uniformly transferred to the whole surface of the recording medium without leaving a margin on the leading end of the recording medium in the feeding direction. Although a slight offset occurs when the peel resistance is greater than 700 gf, the data measured on such conditions is employed without change. The amount of the release agent applied to one recording medium (i.e., a sheet) is calculated based on the change in weight of the release agent applying roller 27 after 1000 recording media have passed the fixing nip portion between the experimental fixing roller 25' and the pressing roller 26.

Figure 3:
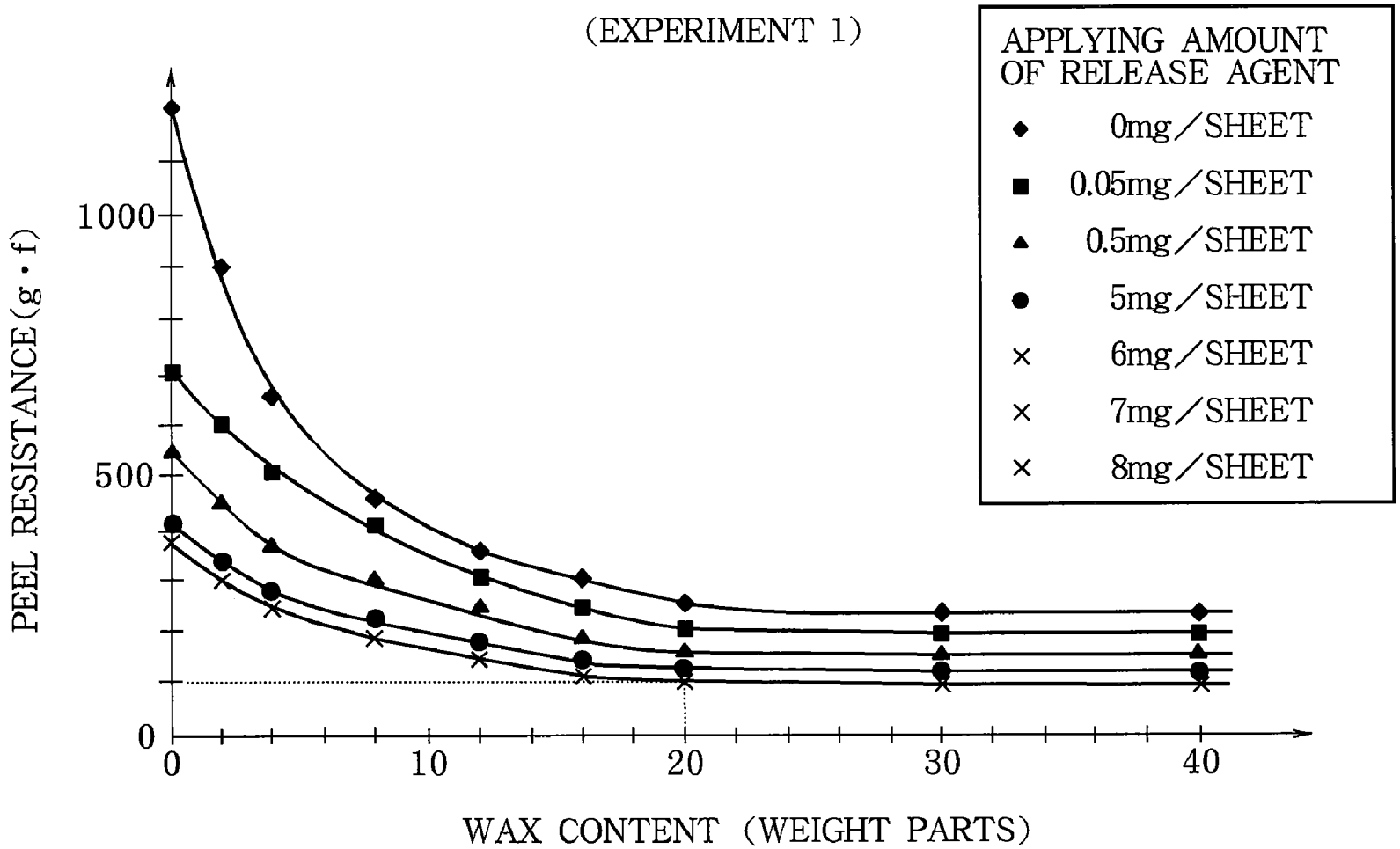
FIG. 3 shows an experimental result on a relationship between a peel resistance and a wax content in a toner when an applying amount of a release agent is varied in the range from 0 to 8 mg per sheet.

FIG. 3 is a graph showing the relationship between the peel resistance and the wax content in the toner 30 when the applying amount of the release agent is varied from 0 to 8 mg per sheet.

In FIG. 3, when the applying amount of the release agent is varied from 0 to 8 mg per sheet, the decrease in peel resistance saturates in the range in which the wax content in the toner is greater than or equals to 20 weight parts. Therefore, it is preferable that the upper limit of the wax content in the toner is 20 weight parts, in terms of reducing the peel resistance. This is because the peel resistance saturates when the wax content is greater than or equals to 20 weight parts as shown in FIG. 3, and because the wax content is preferably as small as possible in order to restrict the agglomeration of the toner when the toner is left for a long time and to prevent the filming in the developing unit. In this embodiment, the experiment is also executed on condition that the wax content in the toner is 0 weight part. The lower limit of the wax content in the toner is 0 weight part.

The minimum saturating value of the peel resistance (with the increase of the applying amount of the release agent) is almost the same when the applying amount of the release agent is 6 mg per sheet, 7 mg per sheet and 8 mg per sheet. In FIG. 3, the results (shown by mark "X") corresponding to the applying amounts of 6 mg per sheet, 7 mg per sheet and 8 mg per sheet overlap with each other. Since the minimum saturating value is approximately 100 gf when the wax content is greater than or equals to 20 weight parts, it is understood that the lower limit of the peel resistance is approximately 100 gf. As described above, when the peel resistance is greater than 700 gf, a slight offset is observed, and therefore the upper limit of the peel resistance is approximately 700 gf. As a result, it is understood that the preferable range of the peel resistance is from 100 gf to 700 gf. Further, as seen from FIG. 3, in the case where the peel resistance is reduced by applying the releasing agent, the peel resistance saturates and becomes almost constant when the applying amount of the release agent is greater than or equals to 6 mg per sheet (i.e., 7 mg per sheet and 8 mg per sheet), and therefore it is preferable that the upper limit of the applying amount of the release agent is approximately 6 mg per sheet.

In order to peel off the recording medium 3 from the fixing roller 25, it is necessary to apply a force (i.e., a peeling force) overcoming the peel resistance. The peeling force is generated when the leading end of the recording medium 3 fails to follow the shape of a downstream end (an exit end) of the fixing nip portion between the fixing roller 25 and the pressing roller 26 due to the rigidity of the leading end of the recording medium 3. To be more specific, if the rubber hardness of the resilient layer of the fixing roller 25 is less than the rubber hardness of the resilient layer of the pressing roller 26, the fixing roller 25 is depressed (by the pressing roller 26) in a concave shape at the fixing nip portion, with the result that the radius of curvature of the fixing roller 25 at the downstream end of the fixing nip portion becomes small. Therefore, when the leading end of the recording medium 3 passes the portion of the fixing roller 25 at which the radius of curvature is small, a large peeling force is generated, so that the leading end of the recording medium 3 is peeled off from the fixing roller 26. The peeling force becomes larger, as the radius of curvature of the fixing roller 25 at the downstream end of the fixing nip portion becomes smaller, and as the recording medium 3 becomes thicker and larger.

Next, the result of an experiment 2 on the peeling force will be described.

FIG. 4 shows the result of determination whether the leading end of the recording medium (whose basis weight is 64 g/m$^2$ and on which the toner image is transferred as in the experiment 1) is peeled off or not, when the rubber hardness (ASKER-C) of an experimental pressing roller 26' is varied. FIG. 4 also shows the maximum peeling force in the case where the recording medium is peeled off from the fixing roller. The peel resistance is determined using the measurement result of the above described experiment 1.

In FIG. 4, the success/failure criteria in the experiment 2 is as follows: if the recording medium 3 is successfully peeled off 5 times out of 5 tests, the experimental result is "success". Otherwise, the experimental result is "failure". In the respective tests (Nos. 1-4), the force corresponding to the largest peel resistance (FIG. 3) is recorded as the peeling force, among the tests in which the recording medium 3 is successfully peeled off. For example, in the test No. 1 under the condition that the rubber hardness of the fixing roller 25 is 70 degrees (ASKER C) and the rubber hardness of the experimental pressing roller 26' is 95 degrees (ASKER C), the peel force of 350 gf is generated, and therefore it is understood that every peeling is successfully carried out when the peel resistance is smaller than or equals to 350 gf.

In the experiment 2, the conditions of the fixing roller 25 and the experimental pressing roller 26' are different from those of the experiment 1 as follows:

The fixing roller 25 has the resilient layer made of silicone rubber having the thickness of 2.0 mm and having the hardness of 70 degrees (ASKER C).

The experimental pressing roller 26' has the resilient layer made of silicone rubber having the thickness in the range from 0 to 2.0 mm (varied) and having the hardness in the range from 50 to 95 degrees (ASKER C).

The reason why the resilient layer (silicone rubber) of the fixing roller 25 has the thickness of 2 mm is as follows. Since the heat source is provided in the fixing roller 25, if the thickness of the resilient layer (silicone rubber) of the fixing roller 25 is thicker than 2 mm, the temperature-rise time becomes long, due to the increase of the heat resistance and the heat capacity. In such a case, the temperature overshoot or undershoot may occur, so that the temperature control may become difficult.

As a result of the experiment 1 shown in FIG. 3 and the experiment 2 shown in FIG. 4, it is understood that the recording medium 3 in the category of a thin copy sheet (whose basis weight is 64 g/m$^2$) with the borderless image formed thereon can be peeled off from the fixing roller 25 in the case where the rubber hardness of the pressing roller 26 is greater than or equal to that of the fixing roller 25, the applying amount of the release agent is 6 mg per sheet, the wax content in the toner is 20 weight parts, and the peel resistance is approximately 100 gf. In contrast, in the case where the rubber hardness of the pressing roller 26 is less than the rubber hardness of the fixing roller 25, the recording medium 3 (whose basis weight is 64 g/m$^2$) with the borderless image formed thereon can not be peeled off from the fixing roller 25.

In the above described experiment 2, the recording medium 3 of A4 size whose basis weight is 64 g/m$^2$ is fed in the width direction. As the basis weight of the recording medium 3 increases, and as the width of the recording medium 3 in the feeding direction decreases, it becomes easy to peel off the recording medium 3 (with the borderless image formed thereon) from the fixing roller 25.

As a result, it becomes possible to peel off the recording medium 3 with the borderless image formed thereon (for example, in the category of a thin copy sheet having the basis weight of 64 g/m$^2$) from the fixing roller 25, by determining the peel resistance according to the wax content in the toner 3 and the applying amount of the release agent applied by the release agent applying member 27, and by setting the rubber hardness of the pressing roller 26 greater than the rubber hardness of the fixing roller 25 so as to generate the peeling force exceeding the peel resistance.

Figure 5:
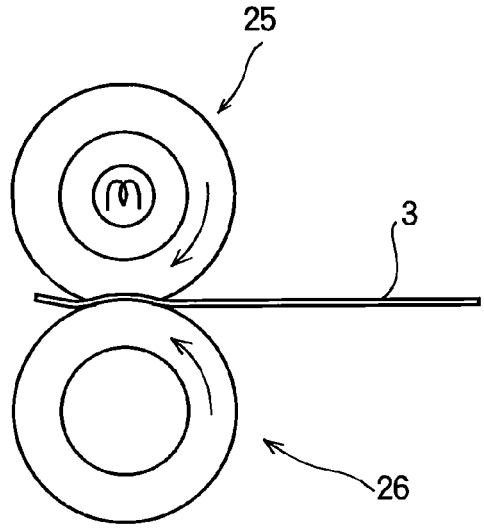
FIG. 5 is a schematic view for illustrating the necessity of the medium separating member.
Figure 6:
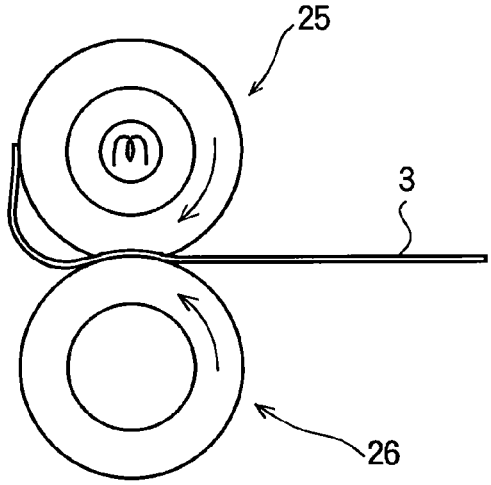
FIG. 6 is a schematic view for illustrating the necessity of the medium separating member.
Figure 7:
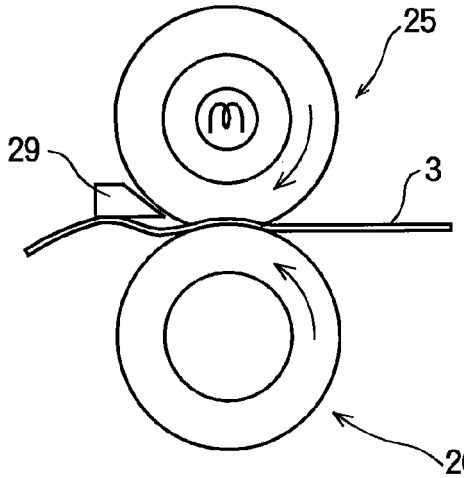
FIG. 7 is a schematic view for illustrating the necessity of the medium separating member.

Here, the necessity of the medium separating member 29 will be described with reference to FIGS. 5 through 7. FIGS. 5 through 7 are schematic views illustrating the state where the recording medium 3 with the borderless image formed thereon is peeled off and separated from the fixing roller 25 after the recording medium 3 passes the fixing nip portion between the fixing roller 25 and the pressing roller 26 in the fixing device 18 (FIG. 2A). In FIGS. 5 through 7, the components other than the fixing roller 25, the pressing roller 26 and the recording medium 3 are omitted.

As described above, by setting the rubber hardness of the pressing roller 26 greater than the rubber hardness of the fixing roller 25, it is possible to generate the peeling force greater than the peel resistance, and therefore it is possible to peel off the leading end of the recording medium 3 (in the category of, for example, a thin copy sheet having the basis weight of 64 g/m$^2$) from the fixing roller 25 as shown in FIG. 5.

However, since the toner image reaches the leading end of the recording medium 3, the leading end of the recording medium 3 lacks firmness, and therefore the leading end of the recording medium 3 tends to easily curl. If the medium separating member 29 is not provided as shown in FIG. 6, when the recording medium 3 is ejected out of the fixing nip portion during the fixing process, the curled recording medium 3 tends to easily stick to the fixing roller 25.

Therefore, as shown in FIG. 7, the medium separating member 29 is disposed so that the medium separating member 29 has no contact with the fixing roller 25. The tip of the medium separating member 29 is in the vicinity of the downstream end of the fixing nip portion, and is closer to the fixing roller 25 than to the pressing roller 26. The gap between the tip of the medium separating member 29 and the fixing roller 25 is in the range from 0.3 mm to 1.0 mm. With such an arrangement, the recording medium 3 (whose leading end is peeled off from the fixing roller 25) can be separated from the fixing roller 25.

As described above, the medium separating member 29 guides the leading end of the recording medium 3 (having been peeled off from the fixing roller 25) in a direction away from the fixing roller 25, and the recording medium 3 can be surely separated from the fixing roller 25 after the fixing process, even when the toner image reaches the leading end of the recording medium 3 so that the leading end of the recording medium 3 lacks firmness and tends to easily curl.

The operation of the above configured image forming apparatus will be described below.

In FIG. 1, the control unit 12 receives a borderless image processing data as a printing data from a host device such as a host computer 100 (FIG. 8) described later, and the control unit 12 creates a borderless image forming data (for example, bitmap data) as a printing image data in a format which is recognizable by the optical writing devices 13 through 16 as lower-level devices. After the borderless image forming data is created, the recording medium 3 is fed from the medium cassette 2. The wiring sensor 6 detects the passage of the leading end of the recording medium 3 and outputs the timing signal to the control unit 12. Then, the transfer belt 17 carries the recording medium 3. The optical writing devices 13 through 16 optically write the borderless image forming data (created by the control unit 12) on the image forming units 8 through 11 at predetermined image writing timings in accordance with the above described timing signal.

The respective image forming units 8 through 11 form toner images corresponding to the borderless image forming data (optically written by the optical writing devices 13 through 16). The transfer belt 17 carries the recording medium 3 and transfers the toner images of the respective colors to the recording medium 3. In this stage, the unfixed toner image (corresponding to the borderless image) formed on the recording medium 3 reaches the leading end of the recording medium 3. The recording medium 3 with the unfixed toner image formed thereon is introduced into the fixing device 18. The fixing device 18 applies heat and pressure to the unfixed toner so that the unfixed toner is melted and is fixed to the recording medium 3. The recording medium 3 with the toner image fixed thereto is ejected to the medium stacker 22, and the printing of the borderless color image is completed.

As shown in FIG. 2A, in the fixing device 18, the fixing roller 25 and the pressing roller 26 are pressed against each other. The fixing roller 25 is heated by the heat source 35 provided in the fixing roller 25. The temperature detector 28 detects the surface temperature of the fixing roller 25. A control unit (not shown) controls the heat source 35 based on the temperature detected by the temperature detector 28, so as to maintain the surface temperature of the fixing roller 25 at a suitable temperature. The release agent is applied to the releasing layer 33 (FIG. 2B) of the fixing roller 25 by the release agent applying member 27, and is held in convexes and concaves (i.e., roughness) of the releasing layer 33. Since the fixing roller 25 and the pressing roller 26 are pressed against each other, and since the fixing roller 25 has the resilient layer 32 (FIG. 2B), the fixing nip portion of the fixing roller 25 forms a concave. The recording medium 3 with the unfixed toner image is carried through the fixing nip portion between the fixing roller 25 and the pressing roller 26. While the recording medium 3 is carried through the fixing nip portion, the unfixed toner on the recording medium 3 is heated and pressed by the fixing roller 25 and the pressing roller 26, so that the unfixed toner is melted and fixed to the recording medium 3.

As described above, since the radius of curvature of the fixing roller 25 at the downstream end of the fixing nip portion is small, the leading end of the recording medium 3 fails to follow the curvature. Further, the releasing layer 33 of the fixing roller 25 has the effect of releasing the recording medium 3. The release agent applied by the release agent applying member 27 and held by the roughness of the releasing layer 33 (FIG. 2B) has the effect of releasing the recording medium 3. The wax contained in the toner 30 has the effect of releasing the recording medium 3. With the combination of these effects, the leading end of the recording medium 3 is peeled off from the fixing roller 25. Furthermore, the leading end of the recording medium 3 having been peeled off from the fixing roller 25 is guided by the medium separating member 29 in the direction away from the fixing roller 25, and therefore the entire recording medium 3 is smoothly separated from the fixing roller 25 without being wound around the fixing roller 25.

With the above described configuration of the fixing device 18, most recording medium 3 can be separated from the fixing roller 25 even if the borderless image is formed on the recording medium 3. However, there is a special recording medium, and therefore it is not always possible to separate the recording medium 3 with the borderless image formed thereon from the fixing roller 25 in the fixing device 18. Therefore, when the user specifies the borderless printing, a borderless printing mode is set, and then whether the borderless printing is possible or not is determined based on the specification and the feeding direction of the recording medium 3.

Figure 8:
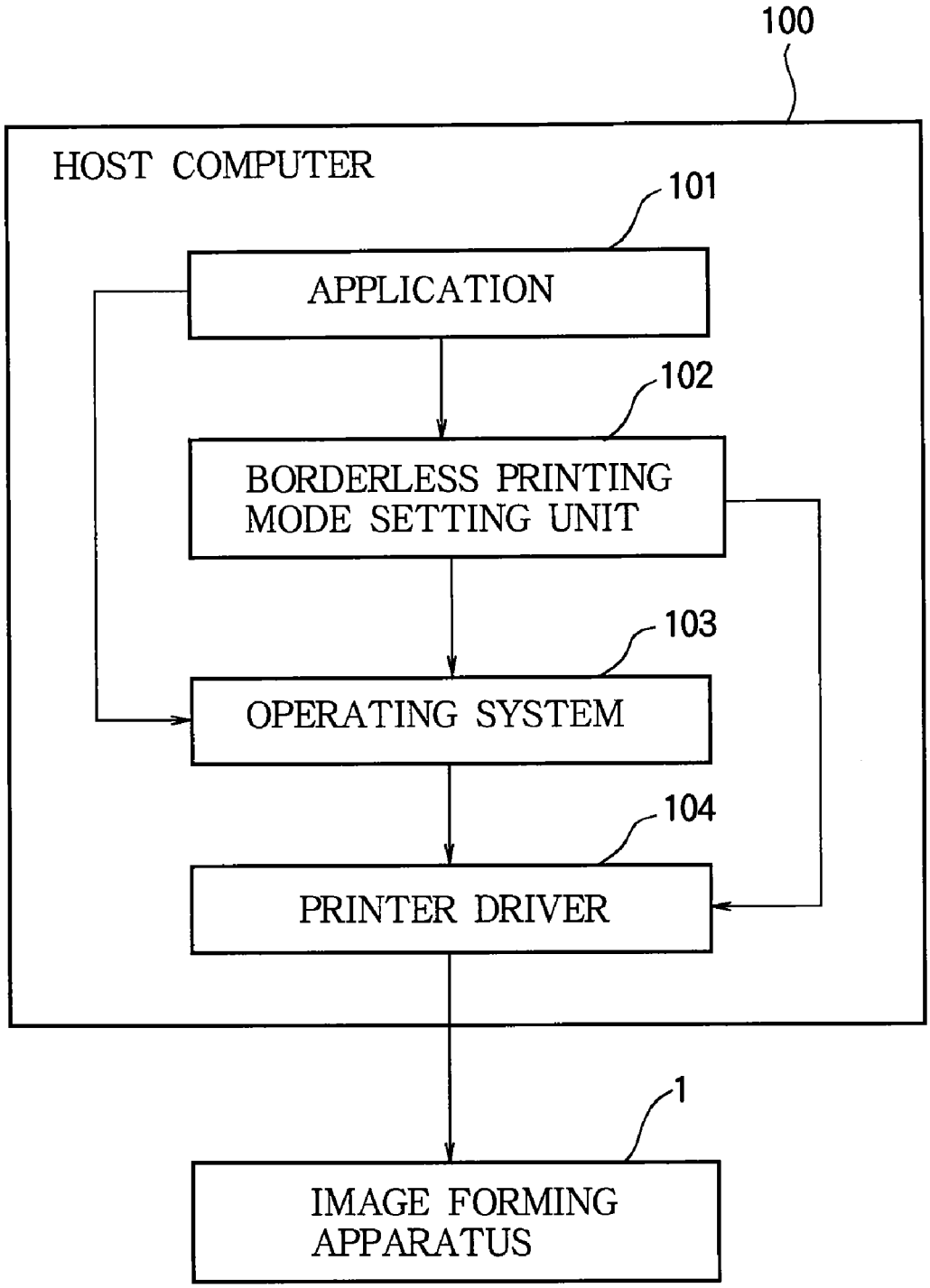
FIG. 8 is a functional block diagram showing an image printing system including an image forming apparatus and a host computer according to Embodiment 1.

Hereinafter, an image printing system according to the Embodiment 1 using the above described image forming apparatus 1 will be described. FIG. 8 is a functional block diagram of the image printing system including the image forming apparatus 1 and a host computer 100 as the host device.

As shown in FIG. 8, the host computer 100 includes an application 101 that performs various printing command, a borderless printing mode setting unit 102 that sets the borderless printing mode, an operating system 103 that performs the data processing of the image data, and a printer driver 104 that determines whether the borderless printing is possible or not.

Figure 9:
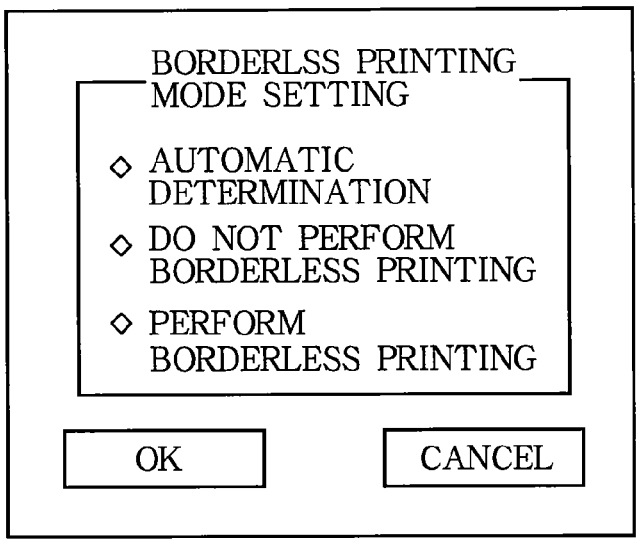
FIG. 9 shows a borderless printing mode setting screen displayed at a command from a borderless printing mode setting unit.

When the application 101 performs the printing, the borderless printing mode setting unit 102 displays a printing mode setting screen 150 exemplified in FIG. 9 on a display unit (not shown), so that the user is able to select the borderless printing mode or bordered printing mode. In a particular example, the user is able to select one of "perform borderless printing", "do not perform borderless printing" and "automatic determination". The data selected by the user (i.e., the decision data) is sent by the borderless printing mode setting unit 102 to a data decision unit 112 (FIG. 11) of the printer driver 104 as described later.

The application 101 outputs the image forming command to a graphic engine in the operating system 103. The operating system 103 calculates an expansion/reduction rate (corresponding to the image forming command from the application 101) at a printing size conversion processing unit of the operating system 103. In the case of the borderless printing, according to the sheet size selected by the printer driver 104, the expansion rates of the image size in the vertical and horizontal directions are calculated with respect to the predetermined borderless image forming area. One of the expansion rates in the vertical and horizontal directions is set to the expansion/reduction rate on the printing operation.

Figure 10:
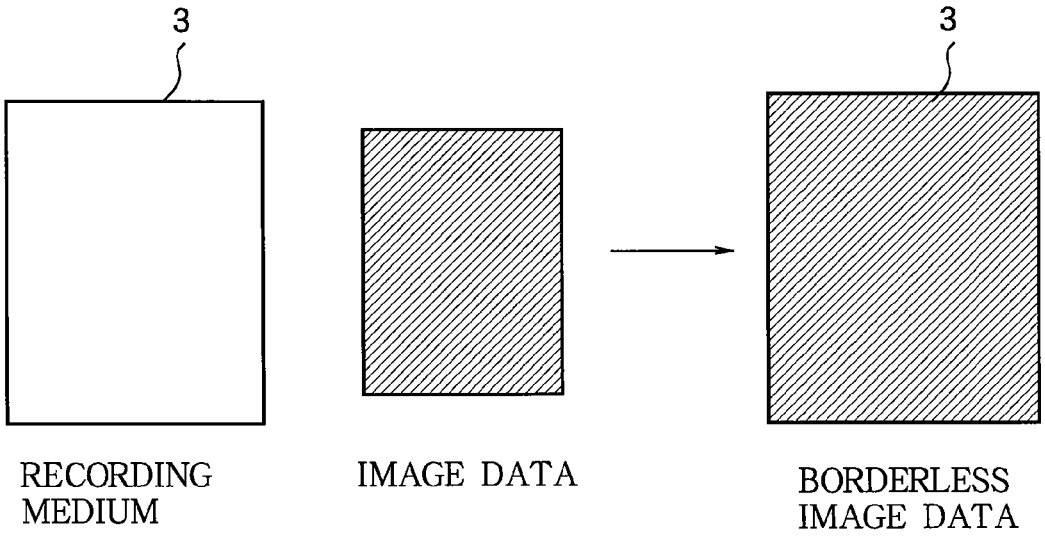
FIG. 10 is a schematic view illustrating a method for setting an expansion/reduction rate, executed by an operating system.

An example of a setting process of the expansion/reduction rate will be described with reference to FIG. 10. As shown in FIG. 10, if the image data is smaller than the recording medium 3, the expansion rate is so set as to match the size of the image data with the recording medium 3. The operating system 103 determines the expansion/reduction rate, creates the image data, and sends the image data to the printer driver 104.

Figure 11:
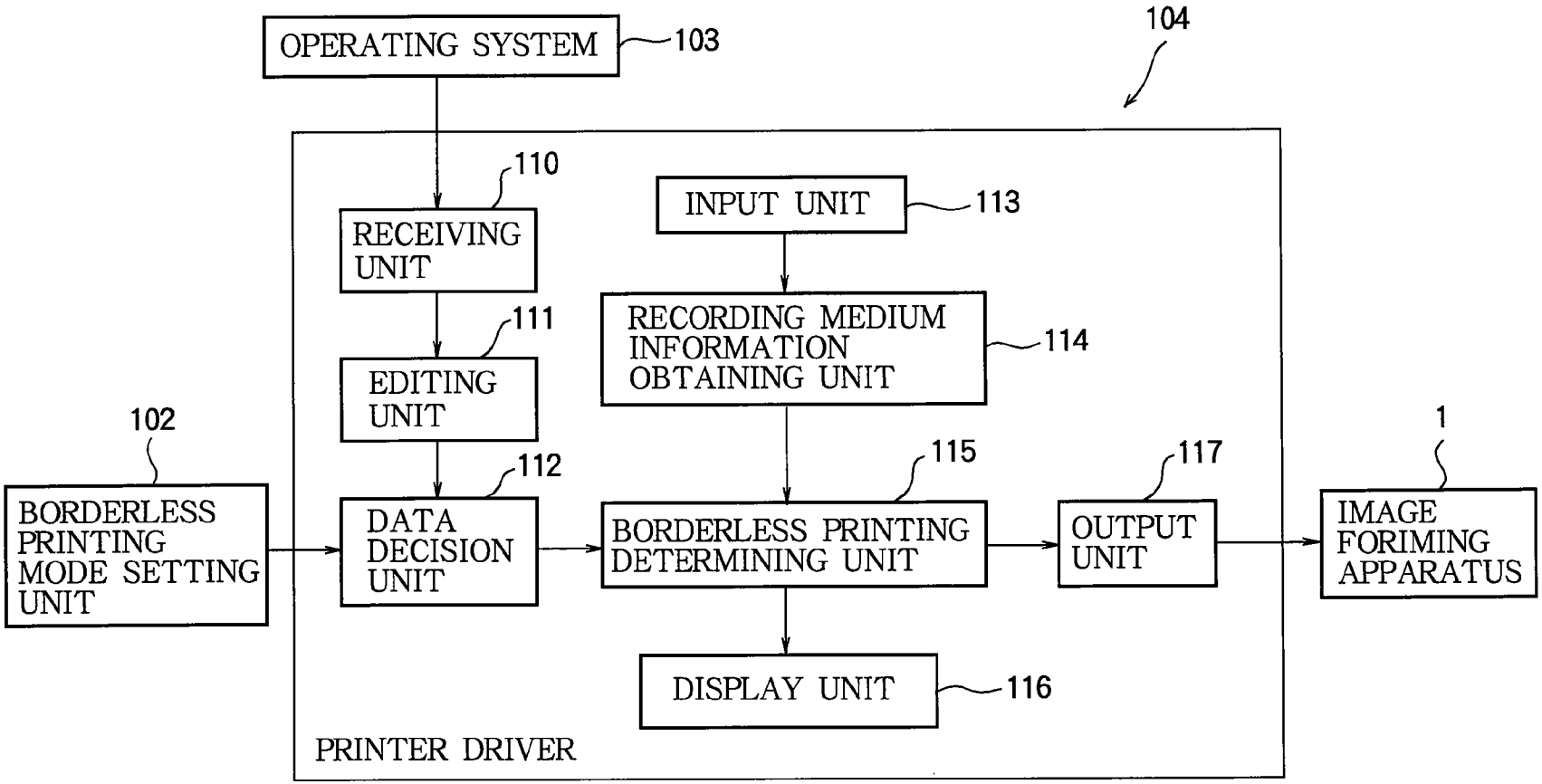
FIG. 11 is a functional block diagram showing a printer driver according to Embodiment 1.

FIG. 11 is a functional block diagram showing the respective operations of the printer driver 104. As shown in FIG. 11, the printer driver 104 includes a receiving unit 110, an editing unit 111, a data decision unit 112, an input unit 113, a recording medium information obtaining unit 114, a borderless printing determining unit 115, a display unit 116 and an output unit 117.

The receiving unit 110 receives the image data as the printing data from the operating system 103. The editing unit 111 edits the image data (obtained by the receiving unit 110) into a printer-specific language such as PCL to create an image processing data as a printing image data in the format which is recognizable by the image forming apparatus 1 as the lower-level device.

The data decision unit 112 decides whether the borderless printing mode is selected at the borderless printing mode setting unit 102. When the automatic determination is selected, the data decision unit 112 decides whether the image processing data is a borderless printing data or a bordered printing data. The decision is based on, for example, whether the size of the image processing data is the same as the size of the recording medium 3 to be used, or whether the vertical or horizontal dimension of the recording medium 3 is the same as the vertical or horizontal dimension of the image processing data. If the size of the image processing data is the same as the size of the recording medium 3, or if the vertical or horizontal dimension of the recording medium 3 is the same as the vertical or horizontal dimension of the image processing data, the data decision unit 112 decides that the image processing data is the borderless printing data, i.e., the borderless printing is selected.

The recording medium information obtaining unit 114 obtains the information of the type of the recording medium 3 inputted by, for example, the user at the input unit 113. The information of the type of the recording medium 3 is, for example, the basis weight, thickness, size, feeding direction, kind of the recording medium 3 or the like. In a particular example, the recording medium information obtaining unit 114 obtains the information of the recording medium 3 inputted by the user at the input unit 113. Alternatively, it is possible that the recording medium information obtaining unit 114 obtains the information of the type of the recording medium 3 inputted at or detected by the image forming apparatus 1.

When the data decision unit 112 decides that the borderless printing is set, the borderless printing determining unit 115 determines whether the borderless printing is possible or not, based on the information (thickness, feeding direction or the like) of the recording medium 3 obtained by the recording medium information obtaining unit 114 as described later. When the borderless printing determining unit 115 determines that the borderless printing is impossible, the display unit 116 displays the message "the borderless printing is impossible" on the screen. When the borderless printing determining unit 115 determines that the borderless printing is possible, the borderless printing determining unit 115 sends the image processing data to which a borderless printing specifying command is added (as described later) to the output unit 117. In contrast, when the borderless printing determining unit 115 determines that the borderless printing is impossible, the borderless printing determining unit 115 does not send the image processing data to the output unit 117. Further, when the data decision unit 112 determines that the borderless printing is not set, the borderless printing determining unit 115 does not determine whether the borderless printing is possible or not, but sends the image processing data to the output unit 117 without change. The output unit 117 receives the image processing data from the borderless printing determining unit 115 and sends the image processing data to the image forming apparatus 1.

It is also possible that, when the borderless printing determining unit 115 determines that the borderless printing is impossible, the borderless printing determining unit 115 informs the image forming apparatus 1, and the image forming apparatus 1 displays the message "the borderless printing is impossible" on a display unit of the image forming apparatus 1.

The image forming apparatus 1 completes the printing of the toner image on the recording medium 3, by forming the toner image according to the inputted image processing data, transferring the toner image to the recording medium 3, and fixing the toner image to the recording medium 3 as described above.

Figure 12:
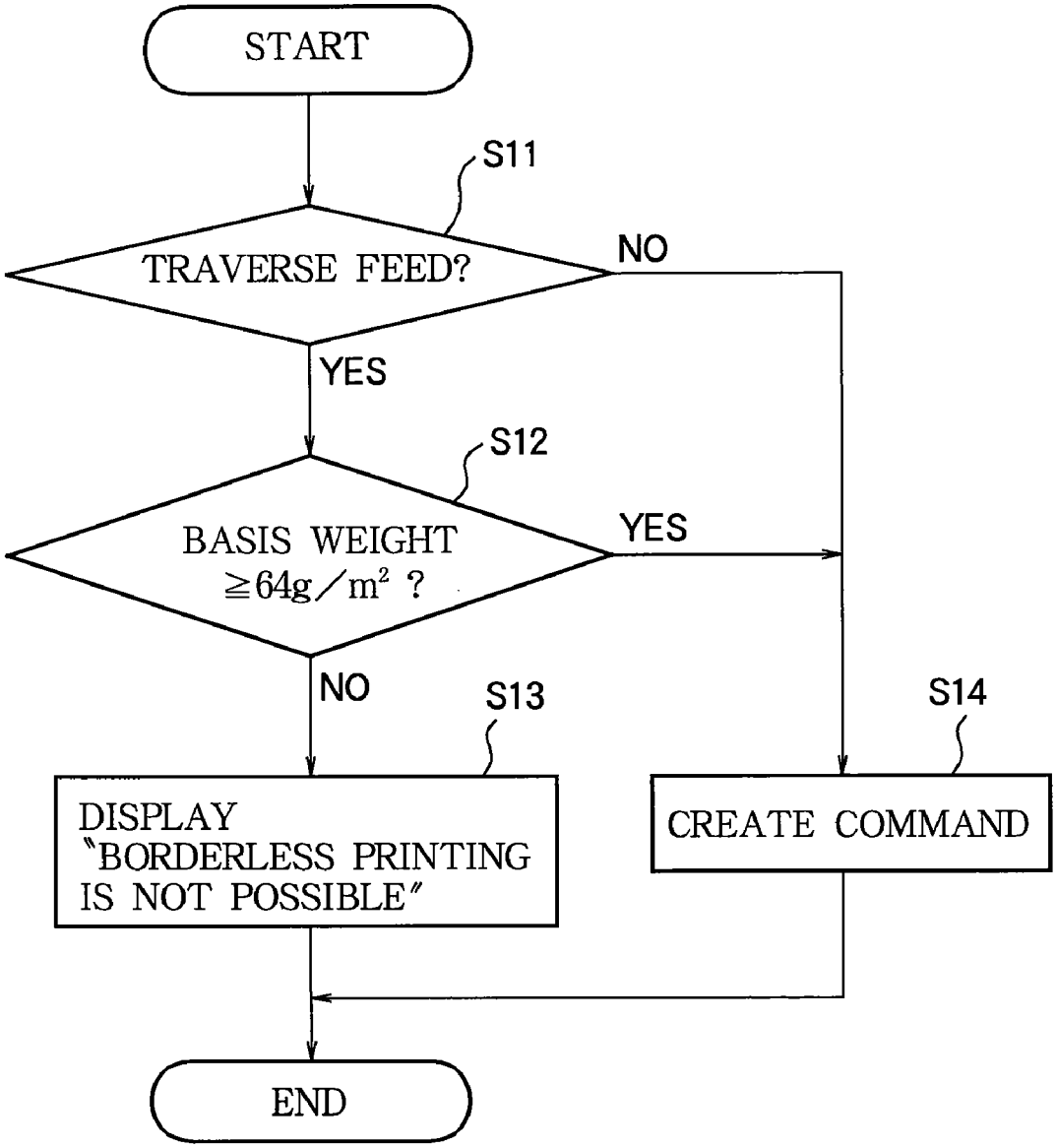
FIG. 12 is a flow chart showing a process for determining whether a borderless printing is possible or not, executed by a borderless printing determination unit.

FIG. 12 is a flow chart illustrating a process for determining whether the borderless printing is possible or not, executed by the borderless printing determining unit 115 (FIG. 11). The determining process executed by the borderless printing determining unit 115 will be described with reference to FIG. 12. The process starts in response to the decision of the data decision unit 112 deciding that the borderless printing mode is set.

In step S11, the feeding direction of the recording medium 3 is determined. If the feeding direction is the width direction of the recording medium 3 (i.e., a traverse feed), the process proceeds to step S12. If the feeding direction is the longitudinal direction of the recording medium 3 (i.e., a longitudinal feed), the process proceeds to step S14. In the traverse feed, the length of the recording medium 3 in the feeding direction is shorter than in the longitudinal feed. Therefore, the firmness of the recording medium 3 decreases, and the peeling force with which the recording medium 3 is peeled off from the fixing roller 25 (FIG. 2) decreases. As a result, the recording medium 3 tends to easily be wound around the fixing roller 25. Therefore, in the case of the traverse feed, the borderless printing determining unit 115 executes further determination (step S12). The determination of the feeding direction (i.e., the traverse feed or the longitudinal feed) is based on the information inputted by the user at the input unit 113 of the recording medium information obtaining unit 114.

In step S12, the borderless printing determining unit 115 determines whether the basis weight (corresponding to the thickness) of the recording medium 3 is greater than or equals to 64 g/m$^2$, or less than 64 g/m$^2$. If the basis weight is greater than or equals to 64 g/m$^2$, the process proceeds to step S14. Generally, as the basis weight (corresponding to the thickness) of the recording medium 3 increases, the recording medium 3 is not easily wound around the fixing roller 25 (FIG. 2). Therefore, the borderless printing determining unit 115 determines that the recording medium 3 is not stably peeled off from the fixing roller 25 when the basis weight is less than 64 g/m$^2$.

In step S13, the borderless printing determining unit 115 displays the message indicating the impossibility of the borderless printing, because the winding of the recording medium tends to occur. For example, the message "the borderless printing is impossible" is displayed. Further, the borderless printing determining unit 115 stops sending the image processing data to the output unit 117. The basis weight of the recording medium 3 is determined in accordance with the information inputted by the user at the input unit 113 of the recording medium information obtaining unit 114. In step S14, since the winding of the recording medium 3 hardly occurs, the borderless printing determining unit 115 creates the borderless printing specifying command (that enables the borderless printing), and sends the borderless printing specifying command to the image forming apparatus 1 together with the image processing data.

If the borderless printing is selected for the traverse feed of the recording medium 3 whose basis weight is less than 64 g/m$^2$, and if the message "the borderless printing is impossible" is displayed, it is possible to perform the borderless printing by changing the feeding direction to the longitudinal direction (i.e., the longitudinal feed). In this embodiment, although the borderless printing is determined to be impossible when the basis weight is less than 64 g/m$^2$ and the traverse feed is selected, the determination can be performed in accordance with other conditions. It is preferable to set optimum conditions for the apparatus.

As described above, in Embodiment 1, it becomes possible to easily peel off the recording medium with the borderless image formed thereon from the fixing roller, and to surely separate the recording medium from the fixing roller, by using the fixing roller to which the release agent is applied (by the release agent applying member) and the medium separating member having no contact with the fixing roller. Further, since the medium separating member and the fixing roller are separate from each other, it is possible to prevent the medium separating member from damaging the fixing roller.

Furthermore, the printing operation is carried out in accordance with the determination whether the recording medium with the borderless image formed thereon can be surely peeled off from the fixing roller or not in accordance with the information of the recording medium. Therefore, it is possible to surely prevent the faulty separation of the recording medium with the borderless image formed thereon from the fixing roller.

Embodiment 2

Figure 13:
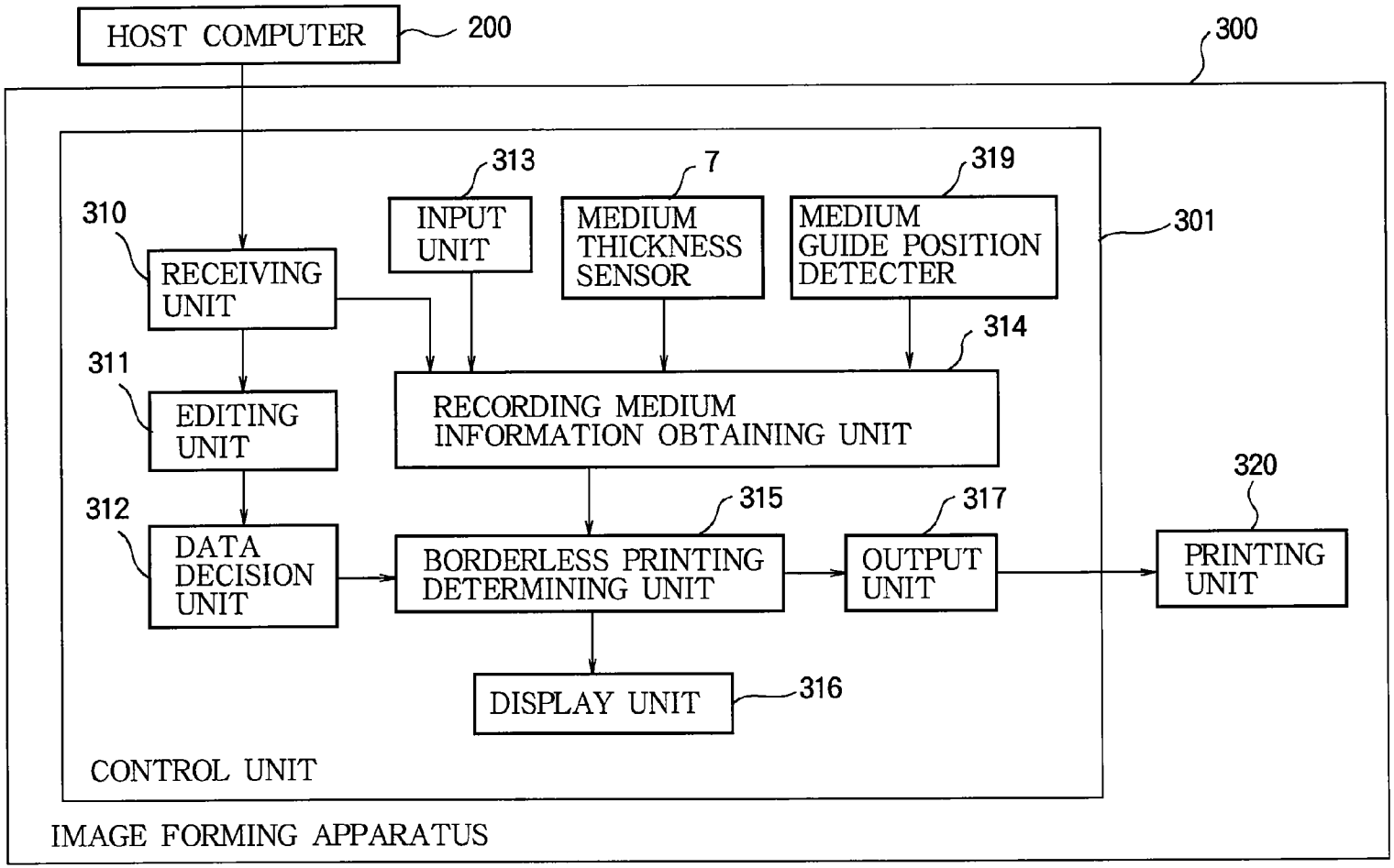
FIG. 13 is a block diagram showing a control system of an image printing system including an image forming apparatus and a host computer according to Embodiment 2 of the present invention.

FIG. 13 is a block diagram showing a control system of an image printing system according to Embodiment 2 of the present invention. The image printing system includes an image forming apparatus 300 and a host computer 200 as a host device.

In the image printing system of Embodiment 1 (FIG. 8), the printer driver 104 of the host computer 100 has the borderless printing determining unit 115 (FIG. 11) that determines whether the borderless printing is possible or not. In contrast, in the image printing system of Embodiment 2, a control unit 301 of the image forming apparatus 300 has a borderless printing determining unit 315 that determines whether the borderless printing is possible or not. Accordingly, the components of the image printing system of Embodiment 2 that are the same as those of the image printing system of Embodiment 1 are assigned the same reference numerals or not shown in Figures, and duplicate explanation is omitted. In the description of Embodiment 2, emphasis is laid on the difference between the image printing systems of Embodiments 1 and 2.

The host computer 200 of the image printing system of Embodiment 2 shown in FIG. 13 is the same as the host computer 100 of Embodiment 1 shown in FIG. 8 except the structure and the operation of the printer driver. The components of the host computer 200 of Embodiment 2 that are different from those of the host computer 100 of Embodiment 1 will be described with reference to FIG. 8.

In the host computer 200, the printer driver (corresponding to the printer driver 104 in FIG. 8) receives the above described image data from the operating system 103, and edits the image data in a printer-specifying language (such as PCL) to create the image processing data. If the borderless printing mode is selected at the borderless printing mode setting unit 102, the printer driver adds the borderless printing specifying command to the image processing data and sends the image processing data to the image forming apparatus 300 (FIG. 13). If the automatic determination mode is selected at the borderless printing mode setting unit 102, the printer driver adds the automatic determination specifying command to the image processing data and sends the image processing data to the image forming apparatus 300 (FIG. 13).

As shown in FIG. 13, the control unit 301 of the image forming apparatus 300 includes a receiving unit 310, an editing unit 311, a data decision unit 312, an input unit 313, a recording medium information obtaining unit 314, a borderless printing determining unit 315, a display unit 316, an output unit 317, a medium thickness sensor 7, and a medium guide position detector 319. Among these components, the receiving unit 310 receives the image processing data (such as PCL) as a printing data from the host computer 200. The editing unit 311 edits the above described image processing data obtained by the receiving unit 310 into the image forming data (for example, bitmap data) as the printing image data that is recognizable by a printing unit 320 as the lower-level device.

When the borderless printing is set by the borderless printing mode setting unit 102 (FIG. 8) of the host computer 200, the data decision unit 312 decides whether the image forming data specifies the borderless printing or not, based on whether the above described borderless printing specifying command is added to the printing data or not. In the case where the automatic determination command is added to the printing data, the data decision unit 312 decides whether the image forming data is the borderless printing data or the bordered printing data. The decision is based on, for example, whether the size of the image forming data is the same as the recording medium 3, or whether the vertical or horizontal dimension of the recording medium 3 is the same as the vertical or horizontal dimension of the image forming data. If the size of the image forming data is the same as the recording medium 3, or if the vertical or horizontal dimension of the recording medium 3 is the same as the vertical or horizontal dimension of the image forming data, the data decision unit 312 decides that the image forming data is the borderless printing data and that the borderless printing is specified.

The recording medium information obtaining unit 314 obtains the information detected or inputted by the medium thickness sensor 7 (see FIG. 1), the medium guide position detector 319, the input unit 313 or the host device. The information is, for example, the basis weight, thickness, size, feeding direction, kind of the recording medium 3 or the like. The medium guide position detector 319 detects the position of a medium guide (not shown) provided in the medium cassette 2 (FIG. 1), and determines whether the feeding direction of the recording medium 3 is the longitudinal direction or the traverse direction, based on the position of the medium guide and the size of the recording medium 3 set at the medium cassette 2.

When the data decision unit 312 decides that the borderless printing is set, the borderless printing determining unit 315 determines whether the borderless printing is possible or not, based on the information (thickness, feeding direction or the like) of the recording medium 3 obtained by the recording medium information obtaining unit 314. When the borderless printing determining unit 315 determines that the borderless printing is impossible, the display unit 316 displays the message "the borderless printing is impossible" on the screen. When the borderless printing determining unit 315 determines that the borderless printing is possible, the borderless printing determining unit 315 sends the image forming data to the output unit 317. In contrast, when the borderless printing determining unit 315 determines that the borderless printing is impossible, the borderless printing determining unit 315 does not send the image forming data to the output unit 317. Further, when the data decision unit 312 decides that the borderless printing is not set, the borderless printing determining unit 315 does not determine whether the borderless printing is possible or not, but sends the image forming data to the output unit 317 without change. The output unit 317 receives the image forming data from the borderless printing determining unit 315 and sends the image forming data to the printing unit 320. The printing unit 12 corresponds to a part of the image forming apparatus 1 except the control unit 12. The image forming data is sent to the optical writing devices 13 through 16 as was described in Embodiment 1.

It is also possible that, when the borderless printing determining unit 315 determines that the borderless printing is impossible, the borderless printing determining unit 315 informs the host computer 200, and a display unit (not shown) connected to the host computer 200 displays the message "the borderless printing is impossible".

The process (executed by the borderless printing determining unit 315) for determining whether the borderless printing is possible or not is the same as the process of the flowchart shown in FIG. 12 executed by the borderless printing determining unit 115 (FIG. 11), and therefore the duplicate explanation is omitted. In this regard, the borderless printing determining unit 315 determines the feeding direction of the recording medium based on the detection of the medium guide position detector 319 at step S11, determines the basis weight of the recording medium 3 based on the thickness detected by the medium thickness sensor 7 during the feeding of the recording medium 3 at step S12, and only sends the image forming data to the output unit 317 at step S14.

As described above, in Embodiment 2, it becomes possible to easily peel off the recording medium with the borderless image formed thereon from the fixing roller, and to surely separate the recording medium from the fixing roller, by using the fixing roller to which the release agent is applied (by means of the release agent applying member) and the medium separating member having no contact with the fixing roller. Further, since the medium separating member and the fixing roller are separate from each other, it is possible to prevent the medium separating member from damaging fixing roller.

Furthermore, the printing operation is carried out in accordance with the determination whether the recording medium with the borderless image can be surely peeled off from the fixing roller or not, based on the information of the recording medium. Therefore, it is possible to surely prevent the faulty separation of the recording medium with the borderless image formed thereon from the fixing roller.

Additionally, the image forming apparatus includes the borderless printing determining unit that determines whether the recording medium with the borderless image formed thereon can surely be peeled off from the fixing roller, and includes a means that obtains the information required to determine the thickness of the recording medium or the like. Therefore, the image forming apparatus can determine (by itself) whether the recording medium with the borderless image formed thereon can surely be peeled off from the fixing roller, without obtaining the information of the recording medium from the host device such as the host computer.

Embodiment 3

Figure 14:
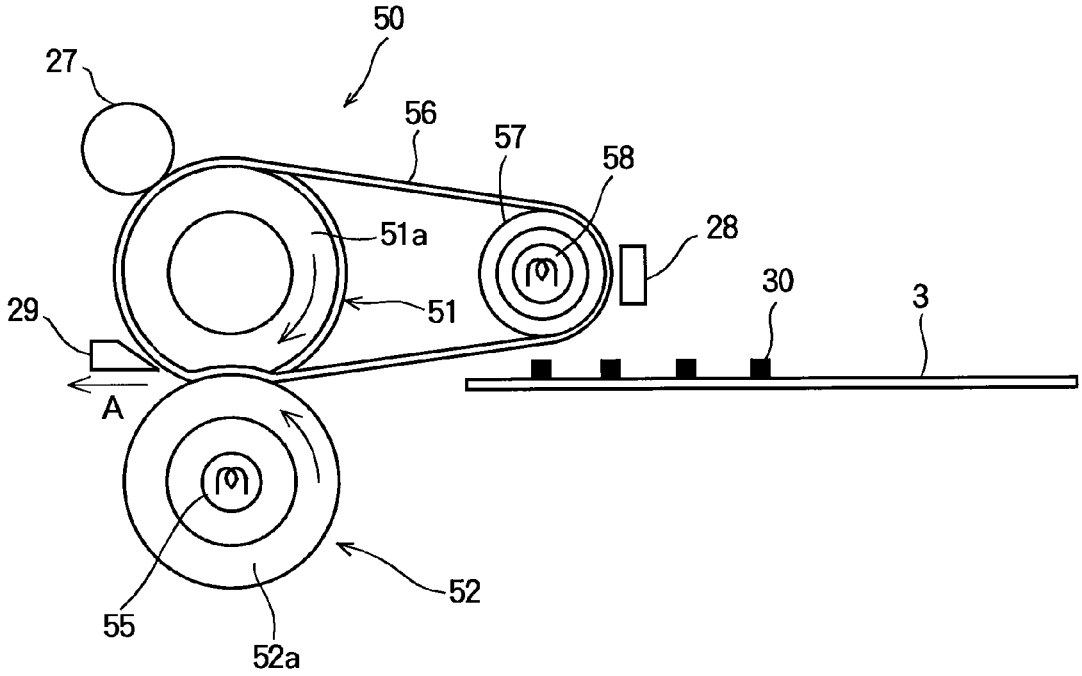
FIG. 14 shows a configuration of a main part of a belt-type fixing device used in an image forming apparatus according to Embodiment 3 of the present invention.

FIG. 14 shows a configuration of a main part of a belt-type fixing device employed in an image forming apparatus of Embodiment 3 of the present invention.

The image forming apparatus using the belt-type fixing device 50 is different from the image forming apparatus 1 of Embodiment 1 (FIG. 1) in structure and operation of the belt-type fixing device 50 (the fixing device 18 in Embodiment 1). Accordingly, the components of the image forming apparatus using the belt-type fixing device 50 of Embodiment 3 that are the same as those of the image forming apparatus 1 of Embodiment 1 (FIG. 1) are assigned the same reference numerals or not shown in Figures, and duplicate explanation is omitted. In the description of Embodiment 3, emphasis is laid on the difference between the image forming apparatuses of Embodiments 1 and 3.

In FIG. 14, a fixing belt 56 is stretched around a fixing roller 51 and a heating roller 57. A heat source 58 is provided in the heating roller 57. A pressing roller 52 having an internal heat source 55 is pressed against the fixing roller 51 via the fixing belt 56. A release agent applying member 27 and a temperature detector 28 contact the fixing belt 56. A toner 30 is transferred to the recording medium 3. The heating roller 57 is made of a metal pipe composed of aluminum, iron, stainless steel or the like. Each of roller portions 51*a* and 52*a* of the fixing roller 51 and the pressing roller 52 includes a hollow metal core and an outer resilient layer formed on the outer surface of the hollow metal core. The resilient layer is made of a rubber having high heat-resistance, such as general silicone rubber, sponge-like silicone rubber, or fluoro-rubber. The hollow metal core is made of a metal pipe composed of aluminum, iron, stainless steel or the like, in order to maintain a certain rigidity.

Figure 15:
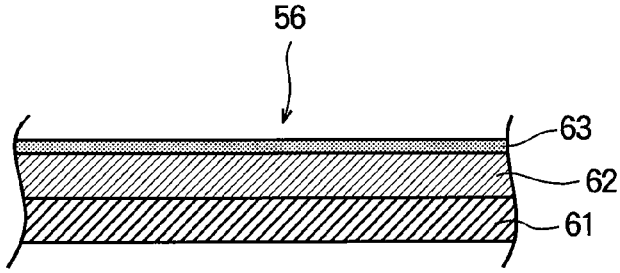
FIG. 15 is a sectional view showing a structure of a fixing belt used in the belt-type fixing device shown in FIG. 14.

FIG. 15 is a sectional view showing the laminated structure of the fixing belt 56. As shown in FIG. 15, the fixing belt 56 is made of a laminated body that includes a substrate 61, a resilient layer 62 and a releasing layer 63, beginning at the bottom. The substrate 61 is composed of nickel, polyimide, stainless-steel or the like. The thickness of the substrate 61 is preferably in the range from 30 to 150 μm. The resilient layer 62 is made of silicone rubber having the thickness preferably in the range from 50 to 300 μm, or fluoro-resin having the thickness preferably in the range from 10 to 50 μm.

The fixing belt 56 is stretched around the heating roller 57 and the fixing roller 51 so that the releasing layer 63 faces outside. The releasing layer 63 can be composed of a resin having high heat resistance and low surface free energy (after molding), for example, representative fluoro resin (whose thickness is preferably in the range from 10 to 50 μm) such as PTFE (Poly-Tetra-Fluoro-Ethylene), PFA (Per-Fluoro-alkoxyl-Alkane), FEP (Fluorinated-Ethylene-Propylene-copolymer) or the like. Further, the releasing layer 63 has a certain roughness with convexes and concaves for holding the release agent applied by the release agent applying member 27.

The medium separating member 29, the release agent applying member 27, the temperature detector 28, the toner 30 and the recording medium 3 are the same as those of Embodiment 1. The fixing roller 51 and the pressing roller 52 are pressed against each other with the fixing belt 56 sandwiched therebetween, and form a fixing nip portion. The medium separating member 29 has no contact with the fixing belt 56. The tip of the medium separating member 29 is in the vicinity of the downstream end of the fixing nip portion and is closer to the fixing roller 51 than to the pressing roller 52. The gap between the medium separating member 29 and the fixing belt 56 is 0.3 mm to 1.0 mm.

The fixing operation of the above constructed fixing device will be described with reference to FIG. 14. The recording medium 3 with the unfixed toner image corresponding to borderless image (reaching the leading end of the recording medium 3) formed thereon is introduced into the belt-type fixing device 50. In the belt-type fixing device 50, the heating roller 57 and the pressing roller 52 are respectively heated by the internal heat sources 58 and 55, and therefore the fixing belt 56 is heated.

The temperature detector 28 detects the surface temperature of the fixing belt 56. A control unit (not shown) controls the heat sources 58 and 55 based on the detected temperature, and maintains the surface temperature of the fixing belt 56 at a suitable temperature. The release agent applied by the release agent applying member 27 is held on the convexes and concaves (i.e., the surface roughness) of the fixing belt 56 (FIG. 15). The recording medium 3 to which the toner 30 is transferred is carried through the fixing nip portion between the fixing belt 56 and the pressing roller 52. In this stage, the unfixed toner 30 on the recording medium 3 is melted by the heat and pressure applied by the fixing roller 51, the fixing belt 56 and the pressing roller 52, and is fixed to the recording medium 3.

Since the fixing belt 56 having the resilient layer and the pressing roller 52 are pressed against each other, and therefore the nip portion of the fixing belt 56 is depressed in the form of a concave. In this embodiment, both of the fixing roller 51 and the fixing belt 56 have the resilient layers, and therefore a wide nip portion is formed by the resilient layer of the fixing roller 51. Accordingly, the radius of curvature of the concave of the fixing nip portion of the fixing belt 56 can be reduced.

The radius of curvature of the fixing belt 56 at the downstream end of the fixing nip portion is very small, and therefore the leading end of the recording medium 3 fails to follow the shape of the fixing belt 56. Further, the release agent of the fixing belt 56 has the effect of releasing the recording medium 3. The release agent applied by the release agent applying member 27 and held on the releasing layer 63 (FIG. 15) has the effect of releasing the recording medium 3. The wax in the toner 30 has the effect of releasing the recording medium. Due to the combination of these effects, the leading end of the recording medium 3 is peeled off from the fixing belt 56. Further, the leading end of the recording medium 3 is guided by the medium separating member 29 in the direction away from the fixing belt 56, and therefore the whole recording medium 3 is smoothly separated from the fixing belt 56 without being wound around the fixing belt 56.

Next, the process in which the recording medium 3 with the fixed toner image is peeled off and separated from the fixing belt 56 will be described.

With the above described combination of the effects, the peeling force (i.e., the force with which the recording medium 3 is peeled off from the fixing belt 56) exceeds the peel resistance, and therefore the leading end of the recording medium 3 is peeled off from the fixing belt 56. However, since the recording medium 3 bears the toner image reaching the leading end thereof, the recording medium 3 lacks firmness, and therefore the recording medium 3 tends to easily curl. Therefore, as the recording medium 3 is ejected out of the fixing nip portion during the fixing process, the leading end of the curled recording medium 3 tends to easily stick to the fixing belt 56. Accordingly, the medium separating member 29 (having no contact with the fixing belt 56) is provided as shown in FIG. 14, and the medium separating member 29 guides the recording medium 3 whose leading end is peeled off from the fixing belt 56 in the direction shown by an arrow A in FIG. 14, so that the recording medium 3 is separated from the fixing belt 56.

As is clear form the result of the experiments 1 and 2 described in Embodiment 1, the leading end of the recording medium 3 can be peeled off from the fixing belt 56 in optimum conditions, by optimizing the release agent and the rubber hardness of the fixing roller 51, the fixing belt 56 and the pressing roller 52.

Moreover, in Embodiment 3, it is possible to perform the borderless printing based on the determination whether the borderless printing is possible or not, by using the image forming apparatus having the belt-type fixing device 50 instead of the image forming apparatus 1 in the image printing system shown in FIG. 8. The operation of the image printing system is the same as that of the image printing system in Embodiment 1 shown in FIG. 8, and therefore the duplicate explanation is omitted.

As described above, in Embodiment 3, it becomes possible to easily peel off the recording medium with the borderless image formed thereon from the fixing roller, and to surely separate the recording medium from the fixing roller, by using the fixing belt to which the release agent is applied (by means of the release agent applying member) and the medium separating member having no contact with the fixing belt. Further, since both of the fixing roller and the fixing belt have resilient layers, it is possible to reduce the radius of curvature of the concave of the fixing nip portion, and therefore the peeling force can be increased. Further, since the medium separating member and the fixing belt are separate from each other, it is possible to prevent the medium separating member from damaging the fixing belt.

Moreover, by arranging the image printing system shown in FIG. 8 to include the image forming apparatus having the belt-type fixing device according to Embodiment 3, the borderless printing is performed based on the determination whether the recording medium with the borderless image formed thereon can be surely peeled off from the fixing belt in accordance with the information of the recording medium.

Therefore, it is possible to prevent the faulty separation of the recording medium with the borderless image from the fixing belt.

In the above described embodiments, the color image forming apparatus is so configured that the toner images formed on the respective image forming units 8 through 11 are directly transferred to the recording medium 3. However, the present invention is not limited to such an image forming apparatus. The present invention is applicable to, for example, an intermediate-transferring type image forming apparatus in which the toner images of respective colors are formed (and superimposed on each other) on an intermediate transferring medium, and then transferred to the recording medium. Furthermore, the present invention is applicable to a 4-cycle type color image forming apparatus in which an intermediate transferring medium rotates and an optical writing device forms toner images of respective colors on the rotating intermediate transferring medium so that the toner images of the respective colors are superimposed on each other.

Additionally, in the above described embodiments, the present invention is applied to the image forming apparatus in the form of the electrophotographic color printer. However, the present invention is not limited to the electrophotographic color printer, but is applicable to the copier, the printer, the facsimile or the like capable of printing monochrome image or color image including two colors or more.

According to the present invention, the leading end of the recording medium can be peeled off from the fixing member, by means of the selection of the kind of the recording medium, the application of the release agent to the fixing member, the selection of the hardness of the fixing member and the pressing member, and the like. Further, the separating member (having no contact with the fixing member) enables the recording medium to be separated from the fixing member without degrading the image quality even when the borderless printing is performed.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

a determining unit that determines whether a borderless image is printable or not, when said determining unit receives a printing data of said borderless image from a host device;

an image forming unit that forms a developer image on a recording medium, using a developer containing a wax, in accordance with said printing data so that said developer image reaches the vicinity of a leading end of said recording medium in a feeding direction thereof, in the case where said determining unit determines to print said borderless image;

a fixing member heated by a heat source so as to fix said developer image to said recording medium;

a pressing member disposed in opposition to said fixing member, said pressing member being pressed against said fixing member to form a nip portion therebetween;

a separating member disposed on a downstream side of said nip portion so that said separating member has no contact with said fixing member, said separating member separating said recording medium from said fixing member, and a release agent applying member that applies a release agent to said fixing member, wherein said determining unit is configured to acquire information including a feeding direction and a basis weight of said recording medium, and determine whether said borderless image is printable on said recording medium or not based on a comparison of the feeding direction and the basis weight of the recording medium to a predetermined basis weight and predetermined feeding direction for which a peeling force between said recording medium and said fixing member exceeds a peel resistance with which said recording medium adheres to said fixing member resisting said peeling force, based on a content of said wax in said developer, an applying amount of said release agent by said release agent applying member, and a resilient hardness of said fixing member and said pressing member.

2. The image forming apparatus according to claim 1, wherein said image forming unit forms said developer image of two colors or more on said recording medium.

3. The image forming apparatus according to claim 1, wherein said fixing member and said pressing member respectively have resilient layers.

4. The image forming apparatus according to claim 3, wherein the hardness of said resilient layer of said pressing member is harder than the hardness of said resilient layer of said fixing member.

5. The image forming apparatus according to claim 3, wherein said fixing member is in the form of a roller, and said resilient layer of said fixing member is composed of a silicone rubber whose thickness is in the range from 0.5 mm to 2 mm, and wherein said nip portion forms a concave in the direction toward said fixing member.

6. The image forming apparatus according to claim 1, wherein said fixing member is in the form of an endless belt and has a silicone rubber layer whose thickness is in the range from 50 μm to 300 μm, and wherein said nip portion forms a concave in the direction toward said fixing member.

7. The image forming apparatus according to claim 1, wherein the amount of said release agent applied by said release agent applying member to said fixing member is less than or equals to 6 mg per sheet of said recording medium of A4 size.

8. The image forming apparatus according to claim 1, wherein said developer contains a wax, and the content of said wax in said developer is less than or equals to 20 weight parts.

9. The image forming apparatus according to claim 1, wherein said recording medium has a peel resistance in the range from 100 gf to 700 gf.

10. The image forming apparatus according to claim 1, wherein said peel resistance is determined by at least said content of said wax in said developer and said applying amount of said releasing agent by said release agent applying member.

11. The image forming apparatus according to claim 1, wherein said peeling force is determined by at least a difference between said resilient hardness of said fixing member and said pressing member, said basis weight of said recording medium, and said feeding direction of said recording medium.

12. An image printing system comprising:

a host device having a setting unit for specifying a printing of a borderless image and a printing data creating unit that creates a printing data of said borderless image when said setting unit specifies said printing of said borderless image;

an image forming unit comprising a determining unit that determines whether said borderless image is printable or not, when said determining unit receives said printing data of said borderless image from said host device, said image forming unit forming a developer image on a recording medium, using a developer containing a wax, in accordance with said printing data so that said developer image reaches the vicinity of a leading end of said recording medium in a feeding direction thereof;

a fixing member heated by a heat source so as to fix said developer image to said recording medium;

a pressing member disposed in opposition to the fixing member, said pressing member being pressed against said fixing member to form a nip portion therebetween;

a separating member disposed on a downstream side of said nip portion so that said separating member has no contact with said fixing member, said separating member separating said recording medium from said fixing member, and a release agent applying member that applies a release agent to said fixing member, wherein said determining unit is configured to acquire information including a feeding direction and a basis weight of said recording medium, and determine whether said borderless image is printable on said recording medium or not based on a comparison of the feeding direction and the basis weight of the recording medium to a predetermined basis weight and predetermined feeding direction for which a peeling force between said recording medium and said fixing member exceeds a peel resistance with which said recording medium adheres to said fixing member resisting said peeling force, based on a content of said wax in said developer, an applying amount of said release agent by said release agent applying member, and a resilient hardness of said fixing member and said pressing member.

13. The image printing system according to claim 12, wherein said image forming unit forms said developer image of two colors or more on said recording medium.

14. The image printing system according to claim 12, wherein said fixing member and said pressing member respectively have resilient layers.

15. The image printing system according to claim 14, wherein the hardness of said resilient layer of said pressing member is harder than the hardness of said resilient layer of said fixing member.

16. The image printing system according to claim 14, wherein said fixing member is in the form of a roller, and said resilient layer of said fixing member is composed of a silicone rubber whose thickness is in the range from 0.5 mm to 2 mm, and wherein said nip portion forms a concave in the direction toward said fixing member.

17. The image printing system according to claim 12, wherein said fixing member is in the form of an endless belt and has a silicone rubber layer whose thickness is in the range from 50 μm to 300 μm, and wherein said nip portion forms a concave in the direction toward said fixing member.

18. The image printing system according to claim 12, wherein the amount of said release agent applied by said release agent applying member to said fixing member is less than or equals to 6 mg per sheet of said recording medium of A4 size.

19. The image printing system according to claim 12, wherein said developer contains a wax, and the content of said wax in said developer is less than or equals to 20 weight parts.

20. The image printing system according to claim 12, wherein said recording medium has a peel resistance in the range from 100 gf to 700 gf.

21. An image forming apparatus comprising:

an image forming unit that forms a developer image on a recording medium, using a developer containing wax, so that said developer image reaches the vicinity of a leading end of said recording medium in a feeding direction thereof;

a fixing portion that fixes said developer image to said recording medium;

a separating member disposed on a downstream side of said nip portion so that said separating member has no contact with said fixing member, said separating member separating said recording medium from said fixing member;

a release agent applying member that applies a release agent to said fixing member by an amount of 6 mg or less per recording medium of A4 size; and a determining unit that determines whether a borderless image is printable or not, when said determining unit receives a printing data of said borderless image from a host device, wherein said fixing portion includes a fixing member with a resilient surface layer and heated by a heat source, and a pressing member with resilient surface layer having Asker-C hardness higher that that of said surface layer of said fixing member by at least 25 degrees, said pressing member contacting said fixing member to form a nip portion therebetween, and wherein said determining unit is configured to determine that said borderless printing is possible when said recording medium has A4 size, when a feeding direction of said recording medium is a width direction, and when a basis weight of said recording medium is 64 g/m$^2$ or more.

* * * * *